US007522863B2

(12) United States Patent
Reichert et al.

(10) Patent No.: US 7,522,863 B2
(45) Date of Patent: Apr. 21, 2009

(54) GEAR TRAIN BACKLASH REMOVAL DURING COMPONENT ACCELERATION IN AN IMAGE FORMING DEVICE

(75) Inventors: Brian Anthony Reichert, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 355 days.

(21) Appl. No.: 11/393,640

(22) Filed: Mar. 30, 2006

(65) Prior Publication Data

US 2007/0231006 A1 Oct. 4, 2007

(51) Int. Cl.
*G03G 15/00* (2006.01)

(52) U.S. Cl. ..... 399/167

(58) Field of Classification Search ..... 399/167, 399/265, 53

See application file for complete search history.

(56) References Cited

U.S. PATENT DOCUMENTS 4,683,411 A * 7/1987 Hamilton et al. ..... 318/706
4,723,145 A 2/1988 Takada et al.
5,235,392 A 8/1993 Hediger
5,502,544 A 3/1996 Carolan
5,508,789 A 4/1996 Castelli et al.
5,543,894 A 8/1996 Carolan
5,729,100 A * 3/1998 Rothstein et al. ..... 318/7
5,805,208 A 9/1998 Meierdiercks
5,848,333 A 12/1998 An
6,072,585 A 6/2000 Dutton et al.
6,114,818 A * 9/2000 Ohtsubo et al. ..... 318/49
6,157,799 A 12/2000 Asakura et al.
6,351,622 B1 2/2002 Sadowara
6,560,434 B2 5/2003 Chapman et al.
6,591,073 B1 7/2003 Fujii
6,701,109 B2 3/2004 Yoda et al.
6,754,463 B2 6/2004 Nishikino et al.
6,810,799 B2 11/2004 Schultheis et al.
6,889,022 B2 * 5/2005 Ehara et al. ..... 399/167
7,099,614 B2 * 8/2006 Koizumi ..... 399/301

* cited by examiner

*Primary Examiner*—Quana M Grainger
(74) *Attorney, Agent, or Firm*—Coats & Bennett PLLC

(57) ABSTRACT

In an image forming device where first and second components are disposed in rotating contact with one another, the first component is driven by a first motor and a second component is driven by a second motor through a gear train with some predetermined backlash. The first and second components can be controllably accelerated according to respective first and second velocity profiles. The second component may be accelerated at a rate faster than the first component by an amount sufficient to substantially eliminate backlash in the gear train by a time the first and second components reach a common process speed. The first and second profiles may be adapted such that the mathematical integral of the time area between curves defining the profiles substantially matches the backlash amount.

20 Claims, 10 Drawing Sheets

GEAR TRAIN BACKLASH REMOVAL DURING COMPONENT ACCELERATION IN AN IMAGE FORMING DEVICE

BACKGROUND

Image forming devices commonly include a plurality of motor control systems to drive various image forming components. For example, one motor control system may be used to drive one or more photoconductive members, including drums, plates, or belts, while another motor control system may be used to drive another component, such as a transport belt, intermediate transfer belt, developer roller, or transfer roller. Furthermore, in some image forming devices, the image forming components are placed in moving contact with one another.

Various considerations arise during the initial startup and acceleration of the image forming components from rest to a process speed. For example, friction exists at the contact surface between components if one component accelerates at a faster rate than another. Significant amounts of friction may produce excessive heat, wear, and power consumption. Another concern relates to image quality. Ideally, image-forming components that are placed in moving contact with one another move at substantially uniform surface speeds with respect to one another. Image smear or image misregistration may result if an image transfer occurs between components that are not at a desired speed or position. Generally, once components reach a steady-state process speed, their respective motor control systems can control the speed and/or position of the components within desired limits. However, when components are accelerating, matching surface speeds may be difficult.

In addition, backlash in a motor gear train may contribute to position errors. Generally, backlash in a gear train should be removed in order for a motor to positively drive a component and for an associated motor control system to control the speed and position of that component. Unfortunately, in certain instances, the interplay of accelerating components that are in contact with one another can have an effect on backlash in one or both of the gear trains driving these components. For example, a first image-forming component may drive a second, adjacent component ahead of the motor that is driving that second component. This situation may result in a lack of control over the speed and/or position of the second component since its motor and associated motor control system are not actually driving that second component. Poor image quality may result for a period of time until the motor control system for that second component causes the motor to eliminate the backlash and positively engage the gear train to drive the second component. In some systems, it may take several printed pages to resolve this misregistration problem. Additional registration errors may ensue if a registration calibration procedure is performed in the image-forming device before the backlash is eliminated in one or more component drive trains.

SUMMARY

Embodiments disclosed herein relate to an image forming device where a first component is rotatably driven by a first motor and a second component that is disposed in rotating contact with the first component is rotatably driven by a second motor through a gear train having a predetermined backlash. One or more motor controllers may accelerate the first and second components according to respective first and second velocity profiles. In one embodiment, the second component may be accelerated at a rate faster than the first component by an amount sufficient to substantially eliminate backlash in the gear train by a time the first and second components reach a common process speed. The first and second velocity profiles may be defined in part by curves representing speed versus time. In this case, the amount of backlash that may be removed according to the embodiments disclosed herein is the mathematical integral of the area between the two curves. Velocity curves defining the different velocity profiles may start and end at substantially similar or different times. The difference in velocity between the two components may vary linearly with time. The first and second velocity profiles may be defined by a common velocity equation, with the second velocity profile further modified by a correction factor.

DETAILED DESCRIPTION

Figure 1:
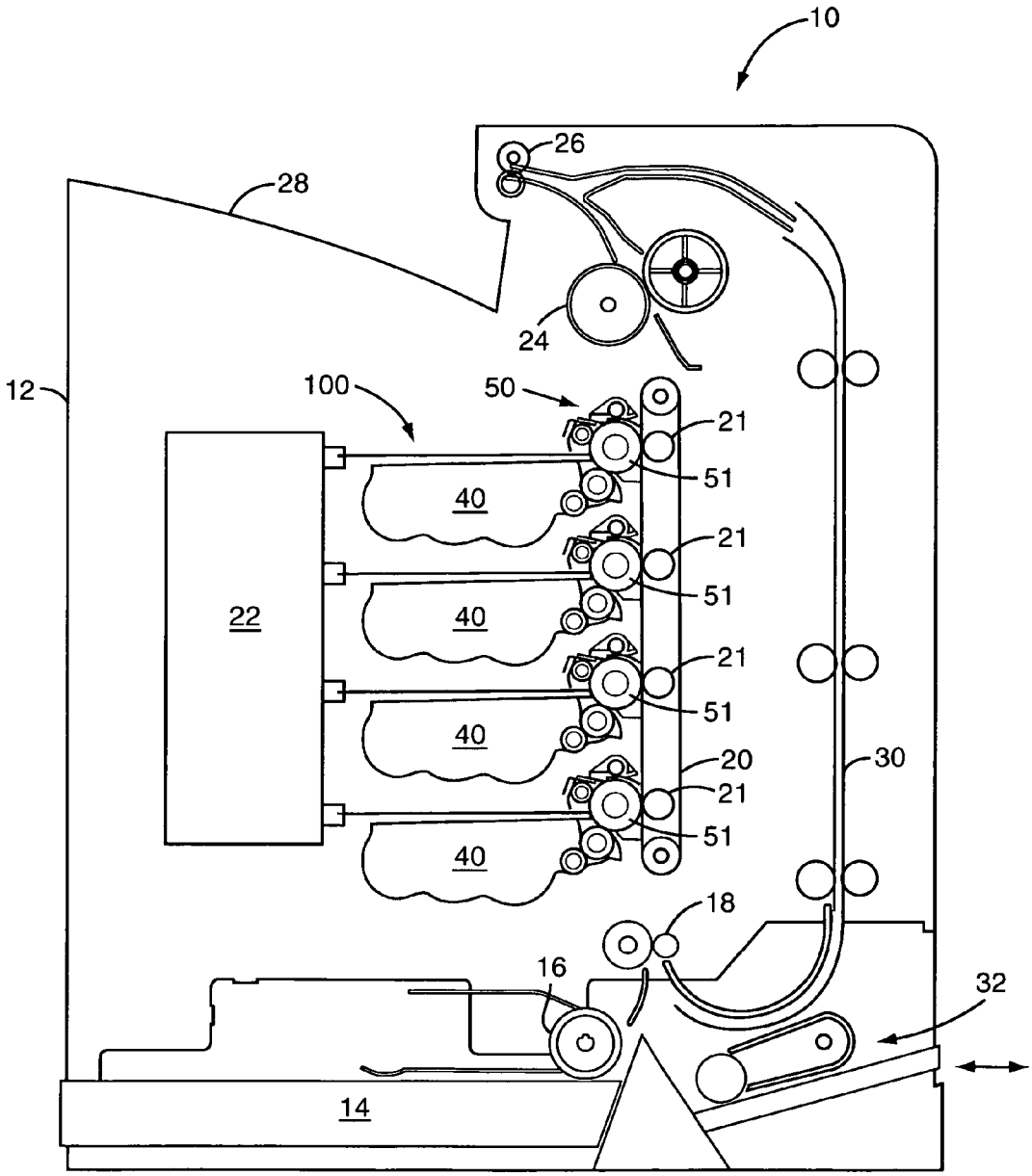
FIG. 1 is a schematic view of an image forming device according to one embodiment.

Embodiments disclosed herein are directed to an image forming device 10, such as a printer, as generally illustrated in FIG. 1. Within the image forming device 10, image forming components are accelerated according to velocity profiles that remove backlash in associated gear trains. The backlash in the associated gear trains may be substantially eliminated in the amount of time it takes to accelerate image forming components to a steady-state process speed. The representative image forming device, indicated generally by the numeral 10, comprises a main body 12. A media tray 14 with a pick mechanism 16, or a multi-purpose feeder 32, are conduits for introducing media sheets into the device 10. The media tray 14 is preferably removable for refilling, and located on a lower section of the main body 12.

Media sheets are moved from the input and fed into a primary media path. One or more registration rollers 18 disposed along the media path aligns the print media and precisely controls its further movement along the media path. A media transport belt 20 forms a section of the media path for moving the media sheets past a plurality of image forming units 100. Each image forming unit 100 comprises a developer unit 40 to carry and supply toner to a photoconductive member 51 in an photoconductive unit 50. Color printers typically include four image forming units 100 for printing with cyan, magenta, yellow, and black toner to produce a four-color image on the media sheet.

An optical device 22 illuminates and creates a latent image on the photoconductive member 51. Toner is supplied to the latent image by the developer unit 40 to develop the image. The developed image is transferred to a media sheet as it passes between the photoconductive member 51 and transfer rollers 21. The media sheet with loose toner is then moved through a fuser 24 that adheres the toner to the media sheet. The sheet is then either forwarded through the output rollers 26 into an output tray 28, or the rollers 26 rotate in a reverse direction to move the media sheet to a duplex path 30. The duplex path 30 directs the inverted media sheet back through the image formation process to form an image on a second side of the media sheet.

The exemplary image forming device 10 illustrated in FIG. 1 is a single-transfer color image forming device. The term "single-transfer" implies that toner is transferred once from the respective photoconductive members 51 onto a media sheet. Other conventional image forming devices 10 use a dual-transfer process whereby toner images are transferred twice: one transfer from a photoconductive member 51 to an intermediate transfer belt and a second transfer from the belt to a media sheet. Monochrome image forming devices may include a single image forming unit where monochrome toner is transferred from a photoconductive member 51 onto a media sheet. In these different types of image forming devices 10, various image forming components move at a system process speed to produce a predetermined number of printed sheets per minute. For example, media sheets may move through an image transfer location at a speed of about 106 mm/sec to generate about 20 pages per minute.

Figure 2:
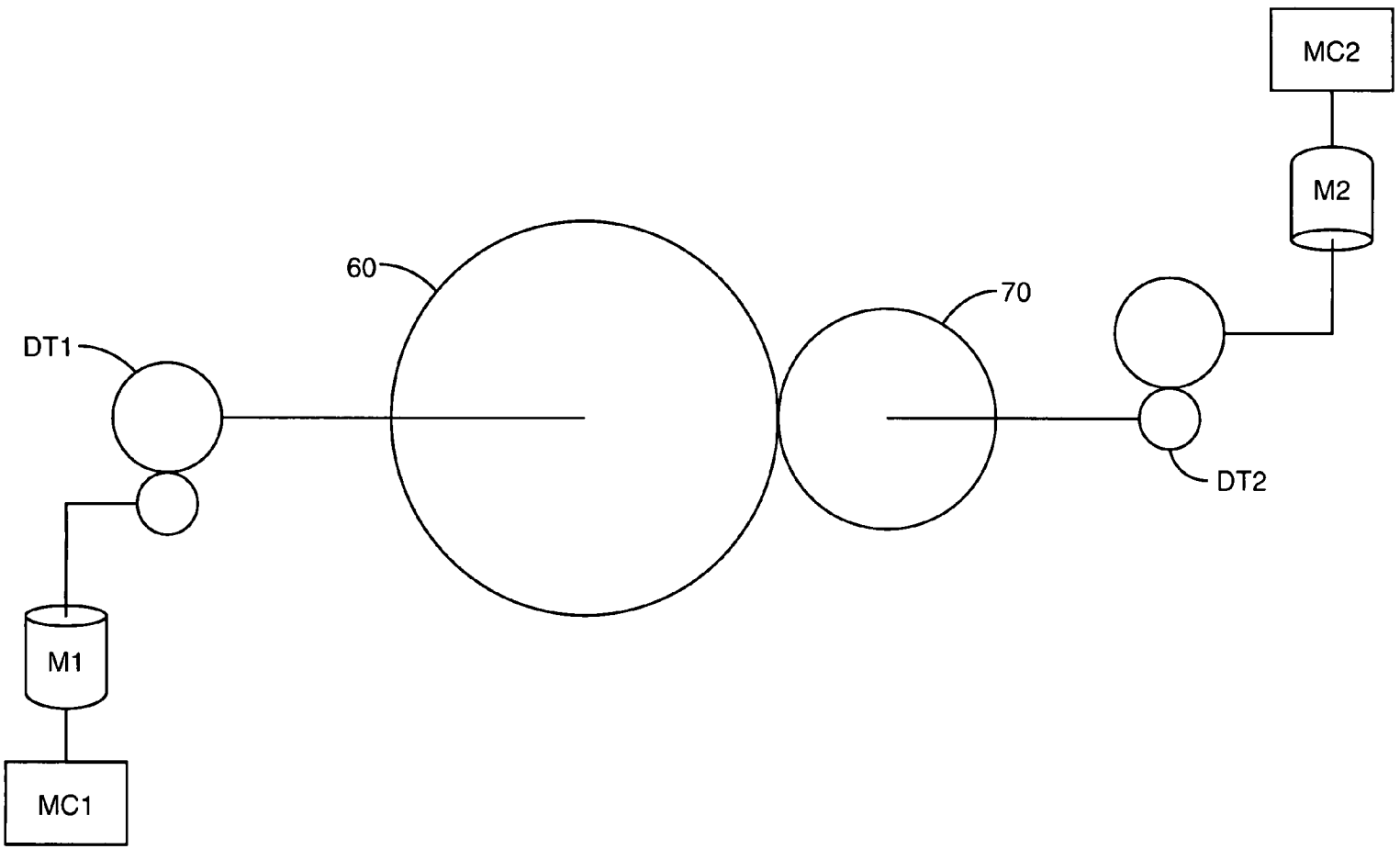
FIG. 2 is a schematic view of respective motor control systems used to drive image forming components in an image forming device according to one embodiment.

FIG. 2 represents a generic configuration whereby two image forming components 60, 70 are driven by separate motors M1, M2 via separate drive trains DT1, DT2. In addition, the motors M1, M2 may be controlled by separate control systems MC1, MC2. The motor control systems MC1, MC2 may be open systems or closed systems using speed or position feedback data. In the configuration shown, the image forming components 60, 70 are illustrated as rotating cylindrical components. Some exemplary image forming components that may be represented by the components 60, 70 in FIG. 2 include photoconductive drums, transfer rollers, developer rollers, fuser rollers, registration rollers, or other media advancement rollers. It should be understood that one or both of the components may be embodied as flexible rotating belts such a transport belt or an intermediate transfer belt. The illustrated components 60, 70 are positioned in rotating contact with one another. The contact force between the two components may be sufficient to create friction that allows the first component 60 to rotate the second component 70 even if the second motor M2 is not driving the second component 70. Similarly, second component 70 may rotate the first component 60 even if the first motor M1 is not driving the first component 60.

The associated drive trains DT1, DT2 may comprise one or more sets of gears having teeth that mesh. Those skilled in the art of mechanical gear trains understand that backlash represents an amount of clearance between mated gear teeth in a gear pair. Backlash in a gear train may be the sum of the backlash values that exist between individual gear pairs. Some backlash is usually desirable to allow for lubrication, manufacturing tolerances in gears, manufacturing tolerances in gear assemblies, and deflection under load. Additional backlash may be created when the tooth thickness of either gear is smaller than nominal or when the teeth in a circular gear (e.g., a spur gear) are located at a smaller radius than nominal. An unfortunate side effect of backlash is that motion is lost due to clearance between gears when movement is reversed and contact is re-established.

In the context of FIG. 2, this lost motion may occur if the motor M1 driving first component 60 pushes the second component 70 ahead of its associated motor M2. In this situation, motor M2 loses contact with the second component 70 due to backlash in the second gear train DT2. Furthermore, the associated motor controller MC2 has difficulty compensating for this backlash. In some cases where feedback data is used, the controller MC2 may receive feedback data indicative of an acceleration and consequently direct the motor M2 to slow down. In other cases where an open loop control is used, the controller may simply assume that the component is moving at the commanded speed and/or position. In either case, the true speed and/or position of the second component is not known.

Figure 3:
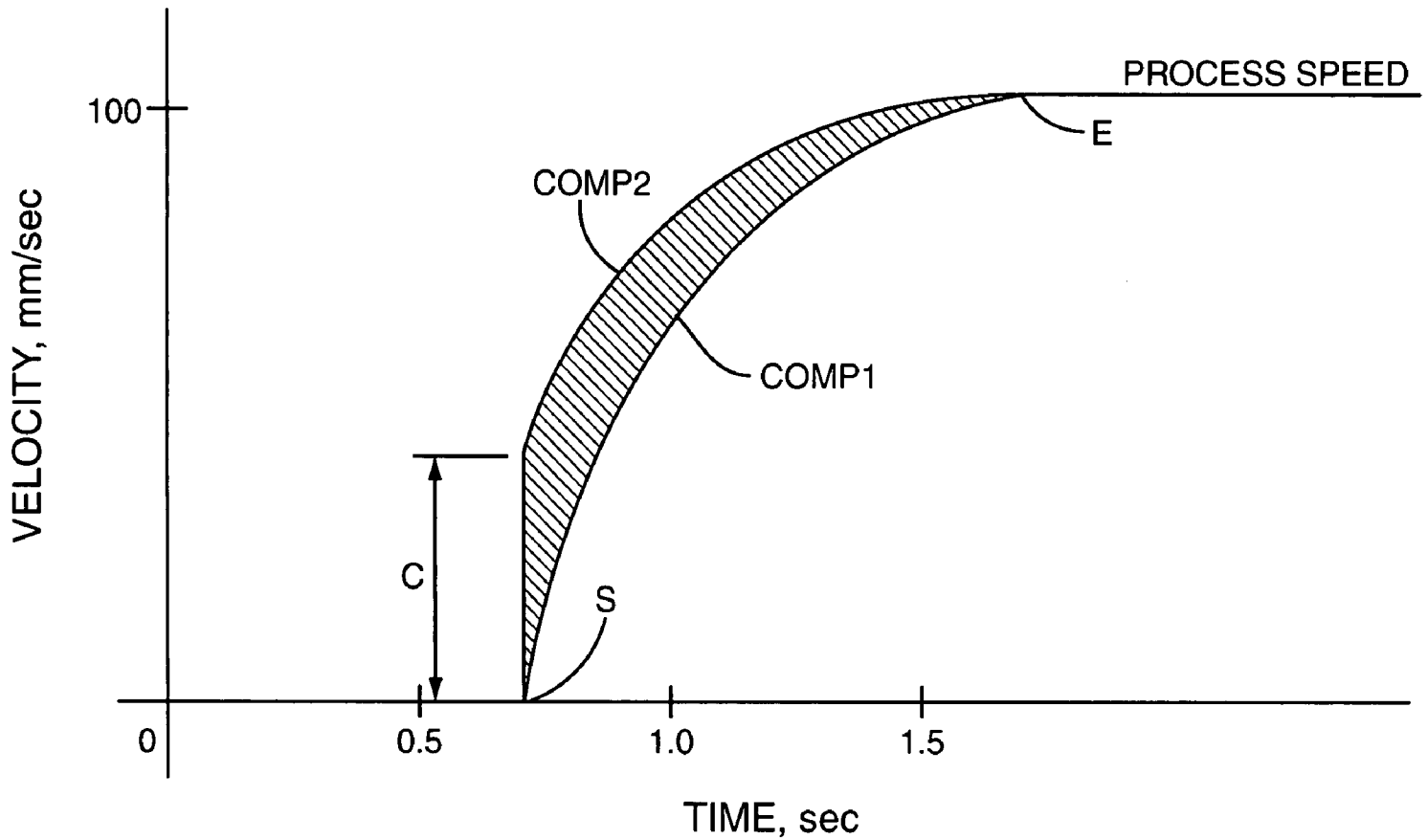
FIG. 3 is a graph representing velocity curves for image forming device components adapted to remove gear train backlash according to one embodiment.

Accordingly, a predetermined velocity profile may be used to accelerate the components 60, 70 from rest or near-rest to the desired process speed. FIG. 3 illustrates one embodiment of a velocity profile used for this purpose. Specifically, two curves COMP1, COMP2 are shown in FIG. 3. The first curve COMP1 defines a velocity curve for the first component 60 from FIG. 2. Likewise, the second curve COMP2 defines a velocity curve for the second component 70 from FIG. 2. In the illustrated example, both curves COMP1, COMP2 begin at the same time with a difference in relative surface speed and end at the same time with the same relative surface speed. However, as embodiments described below bear out, these timing and speed constraints are not explicitly required. The curves COMP1, COMP2 may begin at the same speed and may begin or end at different times.

In the illustrated embodiment, the second component 70 is accelerated at a faster rate than the first component 60. The different acceleration rates are evidenced by the fact that curve COMP2 is above curve COMP1 at all points between start point S and end point E. The curves COMP1, COMP2 may follow a linear velocity profile. However, power consumption may be reduced if curves COMP1, COMP2 follow non-linear functions, such as sinusoidal, exponential, or polynomial functions. In one embodiment, the curves COMP1, COMP2 follow a velocity profile according to the following equation:

$$v(t) = D \cdot \left[ -(K1) \cdot \left( \frac{t}{t_f} \right)^2 + (K2) \cdot \left( \frac{t}{t_f} \right) \right] + I \tag{1}$$

where v(t)=the commanded velocity in mm/sec, t=time in seconds, D=speed difference between start point S and end point E in mm/sec, I=initial speed in mm/sec, and $t_f$=final time in seconds. The velocity profiles may be defined by equation (1), calculatable on the fly in hardware, software, or firmware as the components 60, 70 accelerate. Alternatively, the velocity profile may be defined as discrete, target velocity values that vary with time and that are stored within the image forming device in a location accessible by the controllers MC1, MC2.

Further, it is assumed that the acceleration begins at t=0, regardless of the moment in time at which the acceleration begins. In the velocity curves shown in FIG. 3, the value for $t_f$ is on the order of about 1 second, though smaller or larger numbers may be used. The constants K1, K2 may be adjusted as desired to alter the shape of the velocity curves COMP1, COMP2. These constants K1, K2 may also affect the current draw during the acceleration of the components 60, 70. In one embodiment, K1 is set to 0.75 while K2 is set to 1.75. As t approaches $t_f$, the ratio $(t/t_f)$ approaches unity, which leaves the term [K2−K1] in brackets in equation (1). In addition, since this difference between the constants K1, K2 is also unity, equation (1) further reduces to the steady state speed of D+I. Once the components 60, 70 reach the steady-state speed, the respective motor controllers MC1, MC2 may stop driving the motors according to the velocity curve and simply drive the motors components 60, 70 at the desired speed.

In FIG. 3, curve COMP2 begins at some initial velocity that differs from COMP1 by an amount, C. This velocity difference gradually tends towards zero as the two velocity curves approach the end point E. In the embodiment shown, the end point E is the same for both curves COMP1, COMP2. In an alternative embodiment, the end point E may be different for the two curves. Since the second component 70 accelerates at a faster rate than the first component 60, the second component 70 will have traveled some determinable distance farther than the first component 60 by the time the curves reach the end point E. This distance may be determined by mathematically integrating the area between the two curves COMP1, COMP2 with respect to time as represented by:

$$\int_S^E (V(COMP2) - V(COMP1)) \cdot dt. \tag{2}$$

where V(COMP2) and V(COMP1)=the velocity profiles for the respective components 60, 70. In one embodiment, equation (1) may be used to calculate the quantity defined by equation (2). The velocity profiles may be defined by equation (1), calculatable on the fly in hardware, software, or firmware as the components 60, 70 accelerate. Alternatively, the velocity profile may be defined as discrete, target velocity values that vary with time and that are stored within the image forming device in a location accessible by the controllers MC1, MC2.

Figure 4:
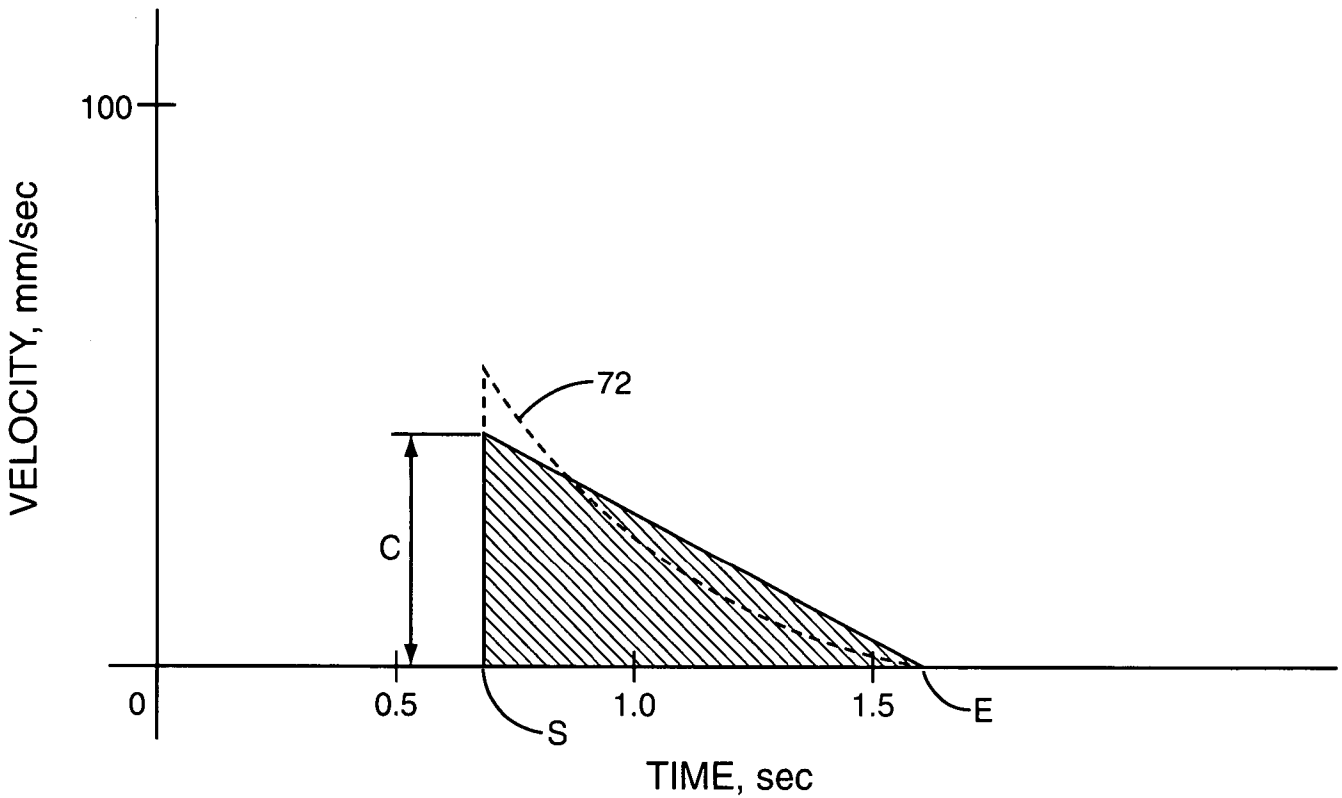
FIG. 4 is a graph representing velocity difference over time for image forming device components representing removed gear train backlash according to one embodiment.

In one embodiment, the difference between the two curves COMP1, COMP2 varies linearly with time so that the area between the two curves COMP1, COMP2 may be represented by the hatched area shown in FIG. 4. This linearly-varying difference may be achieved if both components 60, 70 are accelerated according to the velocity curve defined by equation (1) and the curve COMP2 is further modified by adding the following corrected velocity:

$$c(t) = -\left(\frac{M}{t_f}\right) \cdot t + C \tag{3}$$

where c(t)=COMP2 correction velocity in mm/sec, C=maximum correction velocity in mm/sec, t=time in seconds (same time as equation (1)), and $t_f$=final time in seconds (same time as equation (1)).

The linearly-varying difference depicted in FIG. 4 makes it fairly trivial to calculate the difference in distance traveled by the first and second components 60, 70 when accelerated according to the velocity curves COMP1, COMP2. In this case, the area under the curve is the area of a triangle defined by the height C, and time difference between starting and ending points S and E. As an example, if a one-second acceleration is presumed, and a maximum correction velocity C of 12 mm/sec is assumed, then the area under the curve in FIG. 4 is simply 0.5*12*1 or 6 mm. Therefore, the velocity curves COMP1, COMP2 are sufficient to remove approximately 6 mm of backlash from the second gear train GT2 by the time both components 60, 70 reach process speeds. Clearly, the various parameters may be adjusted so that the actual amount of backlash in a gear train can be removed at the point where the components reach process speeds. In this manner, all the backlash can be removed while still allowing the both motor controllers MC1, MC2 to effectively control the respective motors M1, M2 once the components 60, 70 reach the steady-state process speed. Furthermore, the velocity curves COMP1, COMP2 may be optimized so that the second component 70 is not accelerated too fast relative to the first component 60 as to consume excess power or create excess friction.

FIG. 4 also shows a dashed line 72 illustrating an alternative approach where equation (3) is not used to correct the second velocity curve COMP2. Instead, both velocity curves COMP1, COMP2 may be defined by the same equation (1), but with different values for D (the difference between start and end speeds) and I (the initial start speed). As noted in FIG. 4, this approach will generate a non-linear speed difference between the components 60, 70. However, those skilled in the art will comprehend that the integral of the area between curves COMP1, COMP2 may still be calculated to obtain the amount of backlash that can be removed using this approach. In this case, it may be necessary to implement a slightly larger initial speed difference to offset the smaller latter speed difference that results from this approach.

Figure 5:
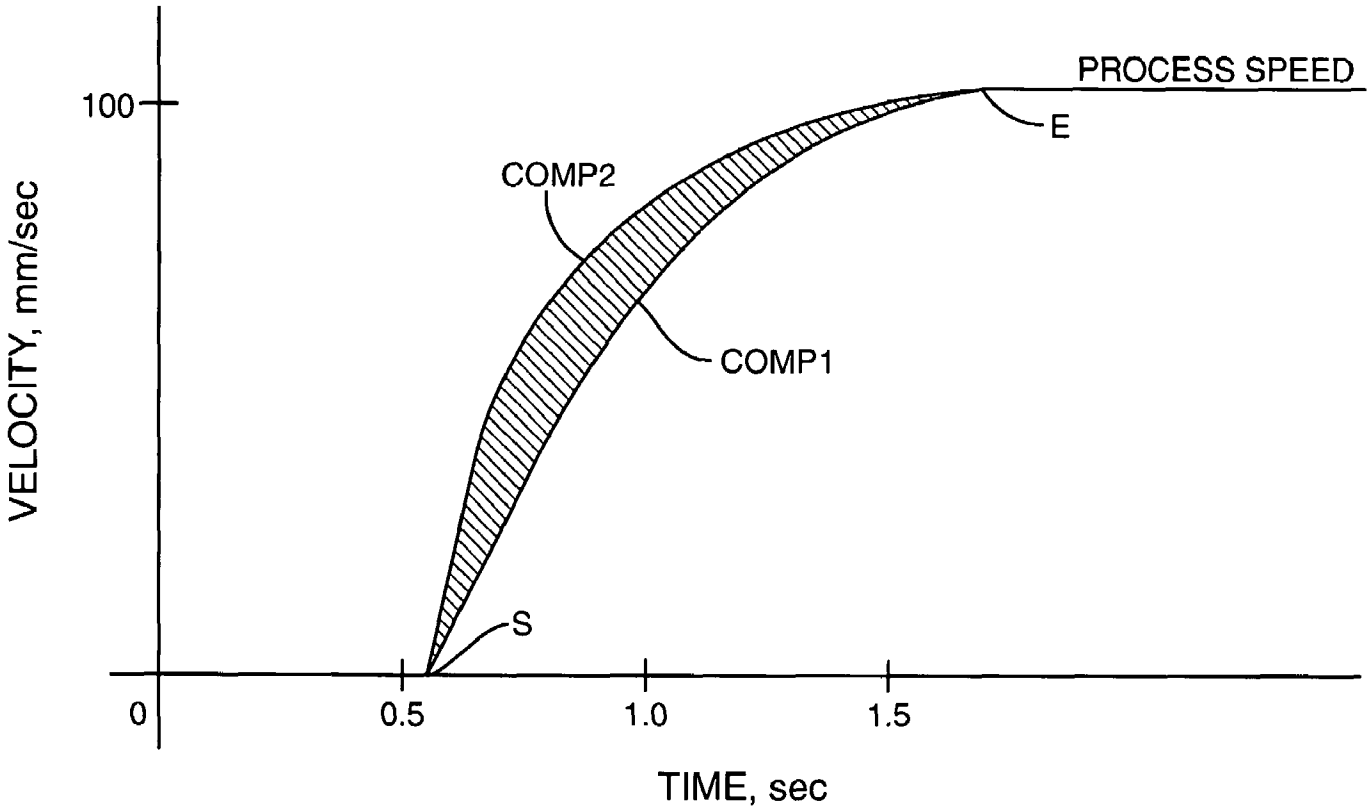
FIG. 5 is a graph representing velocity curves for image forming device components adapted to remove gear train backlash according to one embodiment.
Figure 6:
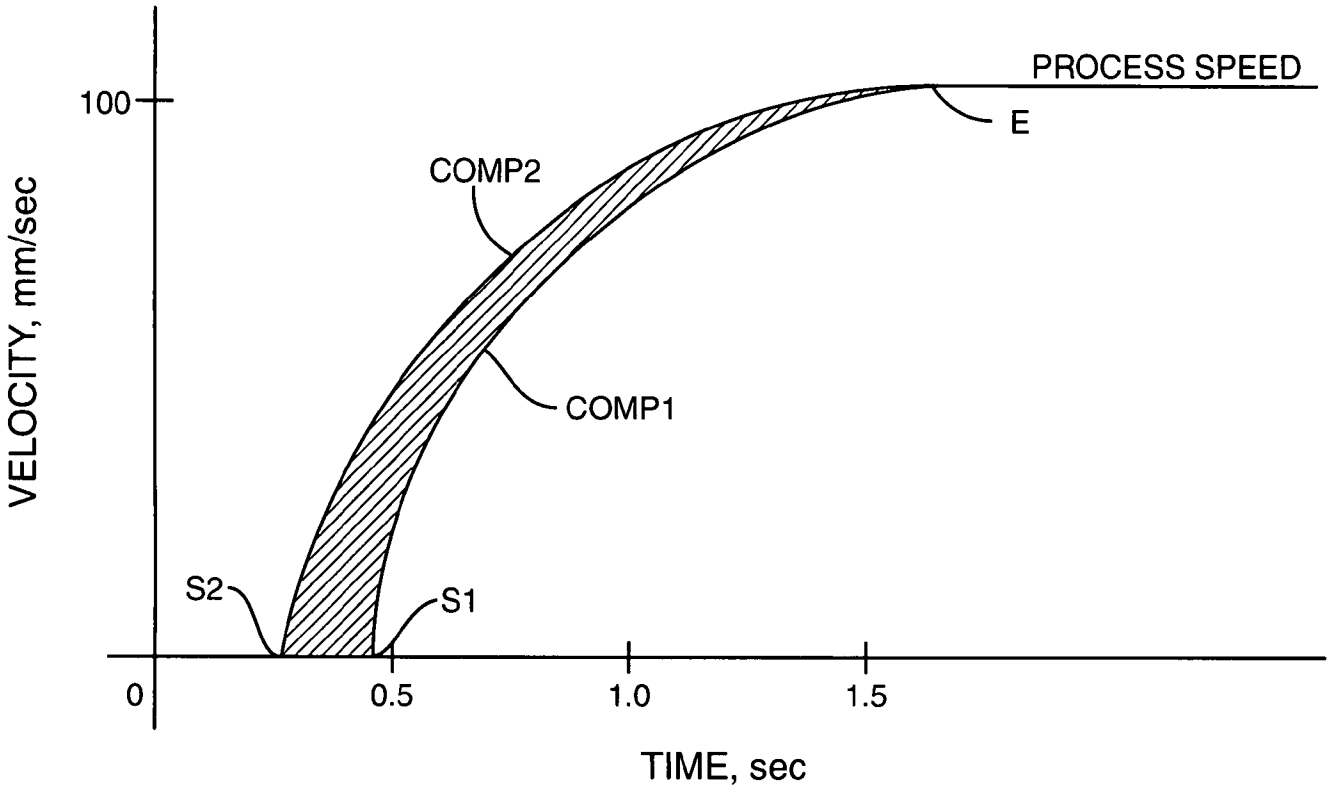
FIG. 6 is a graph representing velocity curves for image forming device components adapted to remove gear train backlash according to one embodiment.

In other embodiments, the velocity curves COMP1, COMP2 may be defined by different equations or by different implementations of the same equation created by using different constants. For example, constants K1, K2 from equation (1) may be adjusted so that both curves COMP1, COMP2 begin and finish accelerating at common points, yet accelerate at different rates as illustrated in FIG. 5. In an embodiment illustrated in FIG. 6, the velocity curves COMP1, COMP2 begin at different times. For instance, curve COMP2 may begin at a start time S2 that occurs before start time S1 for curve COMP1.

Figure 7:
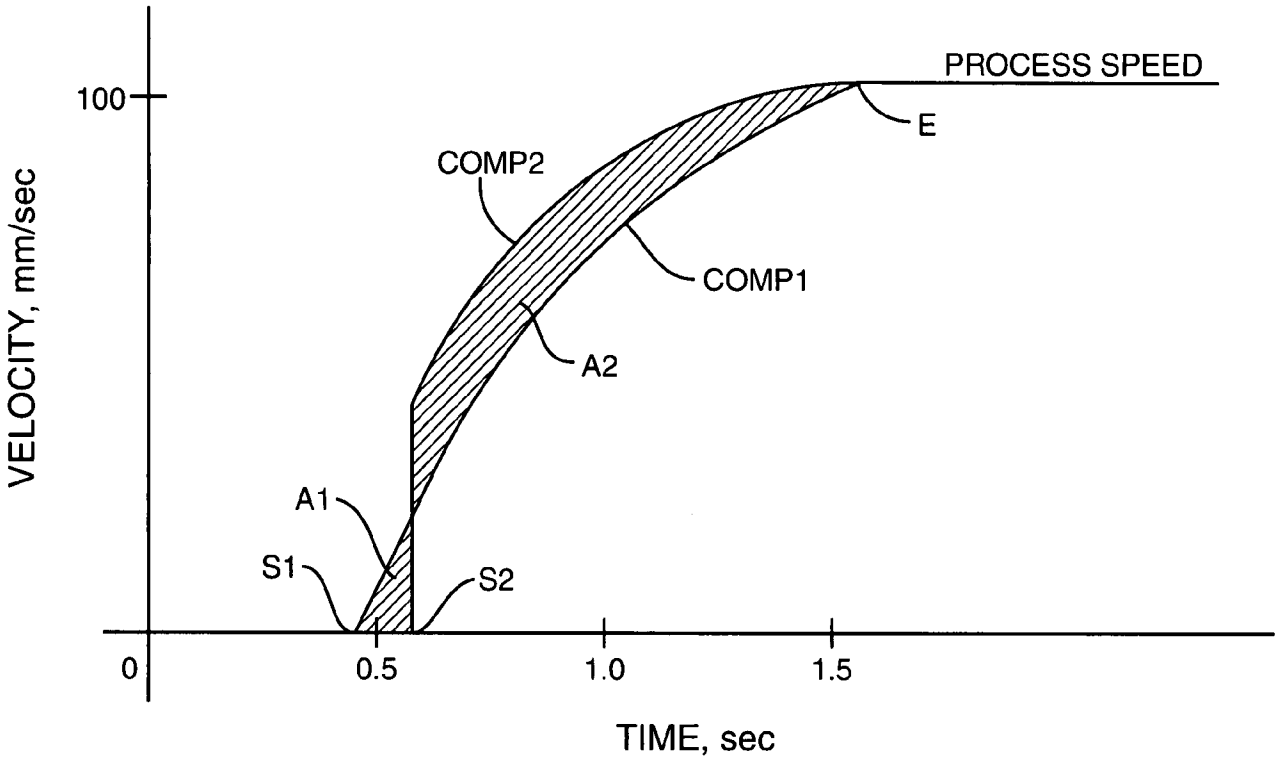
FIG. 7 is a graph representing velocity curves for image forming device components adapted to remove gear train backlash according to one embodiment.

In contrast, FIG. 7 illustrates an embodiment where curve COMP1 starts at a time S1 that is before start time S2 for curve COMP2. This particular embodiment causes the first component 60 to initially accelerate ahead of the second component 70. At some point after the second component 70 begins accelerating, the speed of the second component 70 exceeds that of the first component 60. Consequently, the velocity plot shown in FIG. 7 includes two distinct areas A1, A2 between the two curves COMP1, COMP2. The first area A1 represents that period of time during which the first component 60 is moving faster than the second component 70. The second area A2 represents that period of time during which the second component 70 is moving faster than the first component 60. As a result, in order for a desired amount of backlash in the second gear train GT2 to be removed, the integral of the composite areas A1, A2 should be approximately equal to the desired backlash. Stated another way, the difference between the integral of the individual areas A1, A2 should be approximately equal to the desired backlash.

Figure 8:
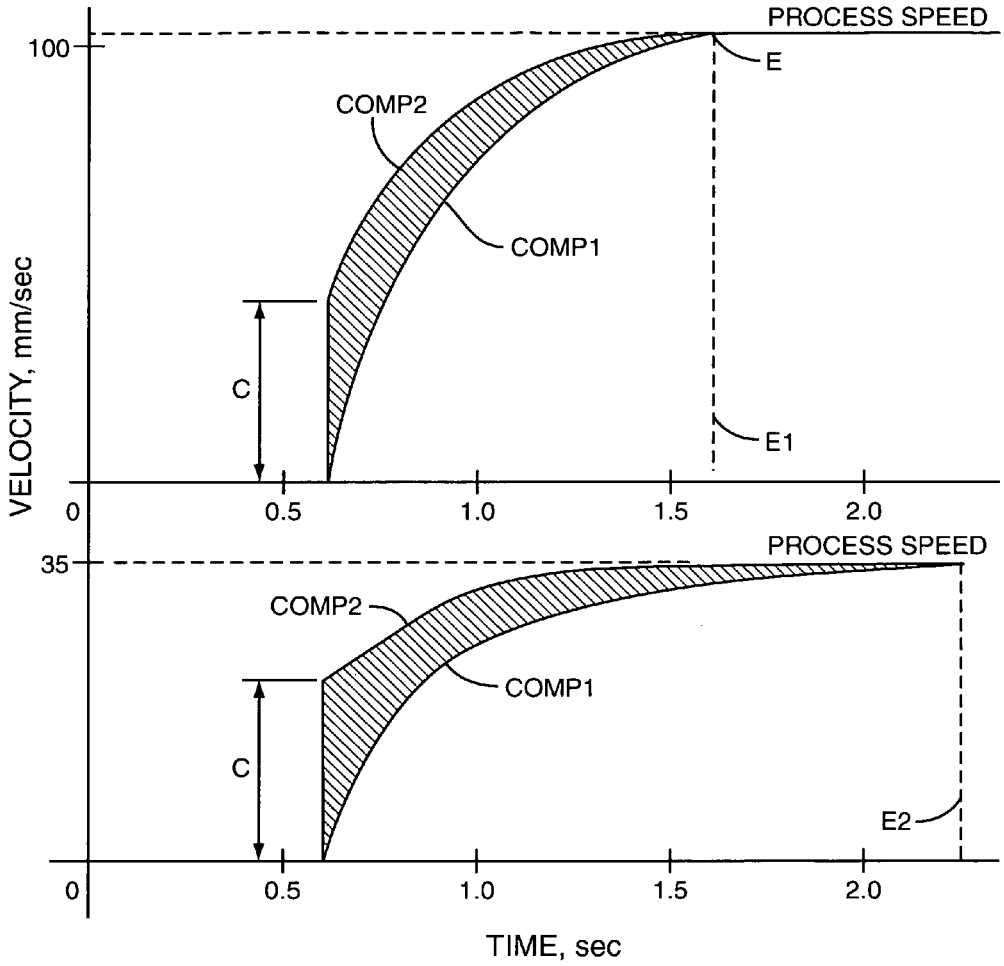
FIG. 8 are graphs representing velocity curves for image forming device components adapted to remove gear train backlash for different process speeds according to one embodiment.

The example velocity curves described above have contemplated a similar process speed that is slightly greater than 100 mm/sec. However, certain image forming devices 10 are capable of producing printed images at different process speeds depending on the selected number of colors or selected print resolution. The duration of the acceleration for the respective components 60, 70 may be modified to account for different process speeds. For instance, with lower process speeds, the velocity curves depicted in FIGS. 3-7 may reach the target process speed before the desired amount of backlash is removed from a component gear train. FIG. 8 illustrates one example of a modification to the acceleration time to appropriately remove the desired amount of backlash.

Specifically, FIG. 8 shows two sets of velocity curves COMP1, COMP2. Equations (1) and (3) above are used for each case, with the acceleration of the second component 70 modified by the correction value C. In the upper set of velocity curves, the final process speed is about 106 mm/sec while the final process speed for the lower set of velocity curves is about 35 mm/sec. In order to remove the desired amount of backlash in the second gear train GT2, the velocity curves COMP1, COMP2 in the lower graph are modified so that they reach the desired process speed at some time E2 that is greater than that (E1) for the upper curves. This extended acceleration provides a greater area between the two curves COMP1, COMP2 that is sufficient to remove the desired backlash. In other embodiments, the time during which components accelerate to a relatively lower process speed may be shortened by increasing the difference in velocity between two components 60, 70 during the acceleration to the lower process speed.

Figure 9:
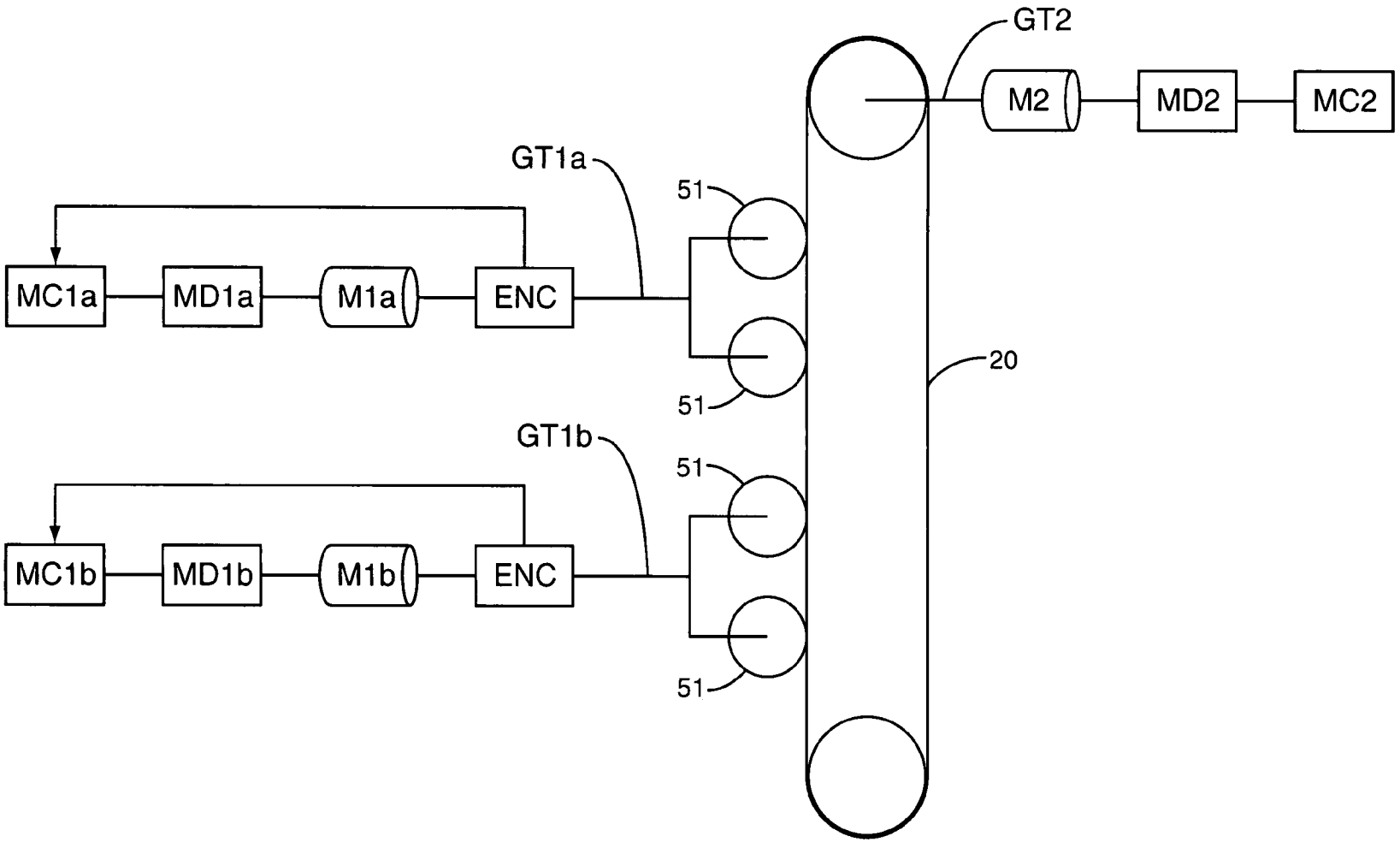
FIG. 9 is a schematic view of respective motor control systems used to drive photoconductive members and a transport belt in an image forming device according to one embodiment.

FIG. 9 shows a specific implementation of the above teachings as applied to the exemplary image forming device illustrated in FIG. 1. In the illustrated embodiment, four photoconductive members 51 are disposed in rotating contact with a transport belt 20. A single motor M1*a*, M1*b*, through respective gear trains GT1*a*, GT1*b*, drives two of the four photoconductive members 51. In the exemplary system, a feedback controlled motor controller MC1*a*, MC1 and motor driver MD1*a*, MD1*b* cooperate to drive motors M1*a*, M1*b*. An associated encoder as is known in the art may provide speed and/or position data. Alternatively, the motors M1*a*, M1*b* may comprise internal frequency generators that are used to indicate the speed/position of the gear trains GT1*a*, GT1*b* and photoconductive members 51.

Similarly, a single motor M2 drives the transport belt 20 through gear train GT2. As suggested above, the contact between the photoconductive members 51 and the transport belt 20 is sufficiently large that motors M1*a*, M1*b* can rotate the transport belt 20 along with the associated photoconductive members. Furthermore, in the illustrated embodiment, the transport belt 20 motor M2 comprises a stepper motor that does not include an associated feedback loop. Instead, the motor controller MC2 and motor driver MD2 accelerate the transport belt 20 according to predetermined velocity profiles stored in memory. The stored velocity profiles may be used to remove backlash in the second gear train GT2 during the period of time that it takes the photoconductive members 51 and transport belt 20 to accelerate to a desired process speed.

In addition to the above considerations, it is not uncommon for motors M1*a*, M1*b* to initially drive the photoconductors 51 at a maximum value. This may be due to the fact that starting loads can be very high if the photoconductive cartridges have been stored for extended periods in high-temperature environments. The motors M1*a*, M1*b* may also be driving other components, such as toner paddles that stir and move compacted toner. Consequently, the motor controllers MC1*a*, MC1*b* may transmit a maximum PWM duty cycle to the associated motor driver MD1*a*, MD1*b* to guarantee that the motors M1*a*, M1*b* are able to initiate motion in the photoconductive members 51.

Figure 10:
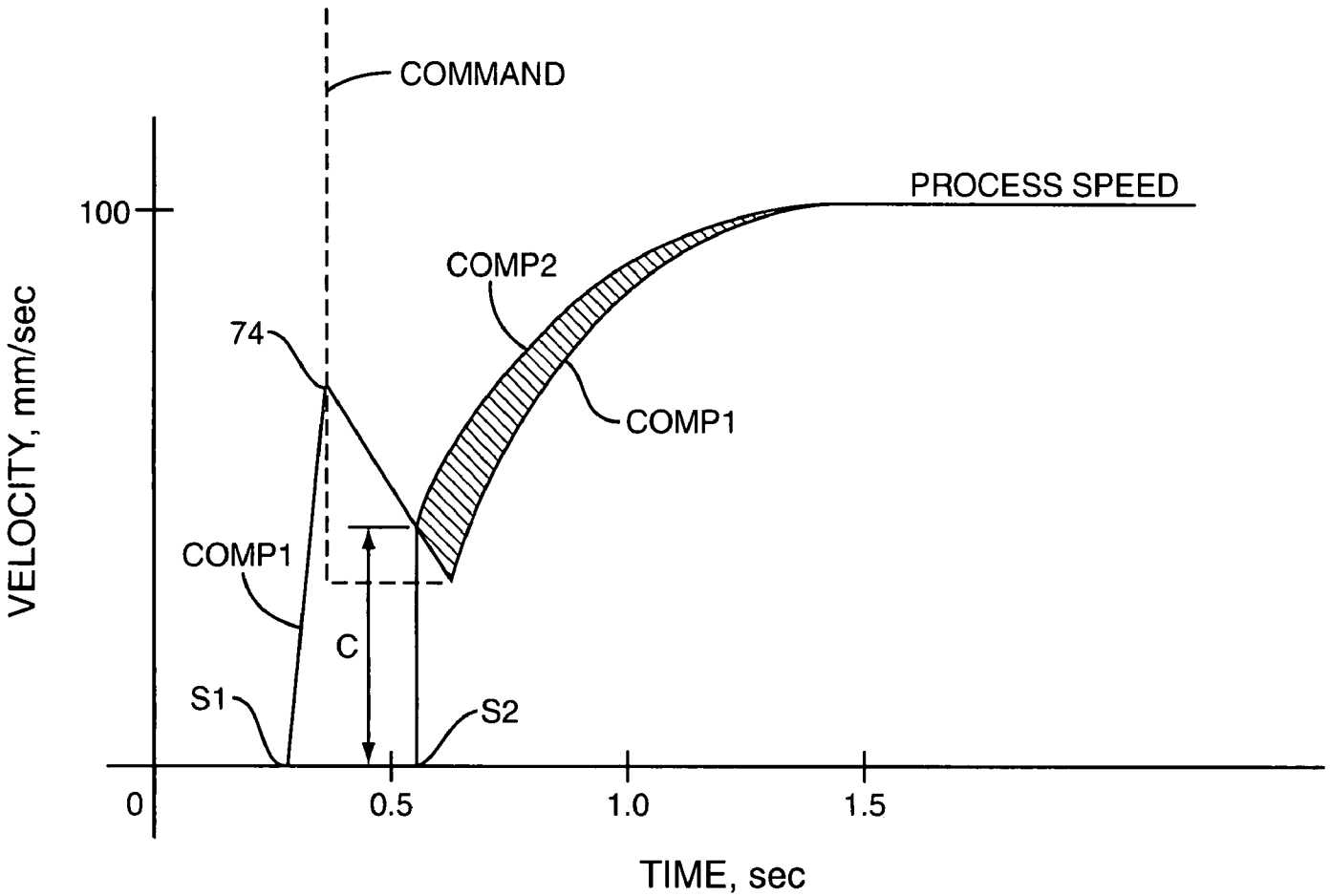
FIG. 10 is a graph representing velocity curves for image forming device components adapted to remove gear train backlash according to one embodiment.

FIG. 10 shows exemplary velocity curves COMP1, COMP2 that account for these considerations associated with the system shown in FIG. 9. As discussed, the photoconductive members 51 are initially driven by a commanded velocity (shown as a dashed line) that is very high. This causes the speed of the photoconductive member 51 (represented by curve COMP1) to accelerate quickly from start time S1 until the commanded velocity falls below the actual speed. At this point 74 the speed of the photoconductive members 51 falls off to match that of the commanded speed. Note that because the transport belt 20 is not yet driven, much or the entire backlash in the transport belt gear train GT2 may be consumed by the motion of the photoconductive members 51. This backlash in the transport belt 20 gear train GT2 may be removed by accelerating the transport belt 20 at a faster rate than the photoconductive members 51.

At start time S2, the transport belt 20 is accelerated from an initial compensation value C towards a desired stead-state process speed. The velocity curve for the transport belt 20 is labeled COMP2 for the sake of consistency. The period of time that the transport belt 20 is moving faster than the photoconductive members 51 is identified by the cross-hatched area between the two curves COMP1, COMP2. Note that this area in FIG. 10 is slightly smaller than a comparable area shown in FIG. 3 given the initial acceleration of the photoconductive members 51. Regardless, the difference in distance that the surface of the transport belt 20 moves relative to the photoconductive members 51 may be determined through a calculation or approximation of the integral of the difference between the curves COMP1, COMP2 during the acceleration period. It is a fairly trivial analysis to show that the acceleration time for the condition represented in FIG. 10 may be extended to achieve the same backlash compensation as compared to that shown in FIG. 3. Alternatively, the velocity profile COMP2 for the transport belt may be made more aggressive than that of FIG. 3 to compensate for the initial acceleration of the photoconductive members 51. Other approaches as described herein may be used to obtain the desired results.

The present invention may be carried out in other specific ways than those herein set forth without departing from the scope and essential characteristics of the invention. For instance, embodiments herein have described techniques for removing backlash in a single gear train. The techniques disclosed herein may be used to remove backlash from branched gear trains, where a single motor drives multiple components. To the extent one or the other gear train has more backlash than the other, the techniques used herein may be used to compensate for the lesser, the greater, or an average of the backlash values. The present embodiments are, therefore, to be considered in all respects as illustrative and not restrictive, and all changes coming within the meaning and equivalency range of the appended claims are intended to be embraced therein.

What is claimed is:

1. An image forming device comprising:

a first component rotatably driven by a first motor;

a second component rotatably driven by a second motor through a gear train, the gear train having a predetermined backlash, the second component being disposed in rotating contact with the first component; and a controller to accelerate the first and second components to a common process speed according to respective first and second velocity curves to substantially eliminate backlash in the gear train;

wherein the first and second velocity curves are defined by a common profile and the second velocity curve includes a correction factor.

2. The image forming device of claim 1 wherein the difference in velocity between the first and second velocity curves varies linearly.

3. The image forming device of claim 1 wherein the first component is a photoconductive member and the second component is a belt.

4. The image forming device of claim 1 wherein the first and second components reach the common process speed at substantially similar times.

5. The image forming device of claim 1 wherein the first and second components start accelerating at substantially similar times.

6. The image forming device of claim 1 wherein the first and second components start accelerating at different times.

7. An image forming device comprising:

image forming means for forming an image on a media sheet;

a first component rotatably driven by a first motor;

a second component rotatably driven by a second motor through a gear train, the gear train having a predetermined backlash, the second component being disposed in rotating contact with the first component; and a controller to accelerate the first and second components according to respective first and second velocity profiles, the second component accelerating at a rate faster than the first component by an amount sufficient to substantially eliminate backlash in the gear train by a time the first and second components reach a common process speed;

wherein the first and second velocity profiles are defined by a common velocity equation, the second velocity profile further modified by a correction factor.

8. The image forming device of claim 7 wherein the difference in velocity between the first and second velocity profiles varies linearly.

9. The image forming device of claim 7 wherein the first component is a photoconductive member and the second component is a belt.

10. The image forming device of claim 7 wherein the first and second components reach the common process speed at substantially similar times.

11. The image forming device of claim 7 wherein the first and second components start accelerating at substantially similar times.

12. The image forming device of claim 7 wherein the first and second components start accelerating at different times.

13. A method of accelerating components to a first process speed in an image forming device, the method comprising:

accelerating a first component to the first process speed according to a first velocity profile;

accelerating a second component that is disposed in rotating contact with the first component to the first process speed according to a second velocity profile; and eliminating a backlash in a gear train that drives the second component by a time the first and second components have accelerated to the first process speed by accelerating the second component at a faster rate than the first component;

wherein the first and second velocity profiles are defined at least partly by respective first and second curves representing velocity versus time.

14. The method of claim 13 wherein a difference in velocity between the second component and the first component varies linearly with time.

15. The method of claim 13 further comprising accelerating the first and second components for a first time duration associated with the first process speed and accelerating the first and second components for a second time duration associated with a second process speed.

16. The method of claim 15 wherein the second process speed is less than the first process speed, the second time duration associated with the second process speed being longer than the time duration associated with the first process speed.

17. The method of claim 15 wherein the second process speed is less than the first process speed, the second time duration associated with the second process speed being shorter than the time duration associated with the first process speed.

18. The method of claim 13 further comprising starting the acceleration of the first and second components at substantially similar times.

19. The method of claim 13 further comprising starting the acceleration of the first and second components at different times.

20. The method of claim 13 further comprising terminating the acceleration of the first and second components at substantially similar times.

* * * * *